US007389902B1

(12) United States Patent
Co

(10) Patent No.: US 7,389,902 B1
(45) Date of Patent: Jun. 24, 2008

(54) STAPLER THAT REQUIRES EXERTION OF LESS EFFORT

(75) Inventor: Victor Co, Kowloon (HK)

(73) Assignee: Cosimex (H.K.) Limited, Kowloon (HK)

( * ) Notice: Subject to any disclaimer, the term of this patent is extended or adjusted under 35 U.S.C. 154(b) by 0 days.

(21) Appl. No.: 11/693,749

(22) Filed: Mar. 30, 2007

(51) Int. Cl.
*B27F 7/19* (2006.01)

(52) U.S. Cl. ..... 227/131; 227/2; 227/120

(58) Field of Classification Search ..... 227/131, 227/120, 2

See application file for complete search history.

(56) References Cited

U.S. PATENT DOCUMENTS 4,720,033 A * 1/1988 Olesen ..... 227/131
4,726,505 A * 2/1988 Okazaki ..... 227/132
4,807,793 A * 2/1989 Ghibely ..... 227/131
5,413,266 A * 5/1995 Jairam ..... 227/129
2002/0158101 A1* 10/2002 Huang ..... 227/7
2003/0197045 A1* 10/2003 Luo ..... 227/2

* cited by examiner

*Primary Examiner*—Rinaldi Rada
*Assistant Examiner*—Michelle Lopez

(57) ABSTRACT

A stapler that requires exertion of less effort comprising a body, an electric motor, a power supply, a power supply switch, a motion transmission mechanism having a gear cluster driven by the electric motor, a staple driving mechanism having a driving blade and a staple magazine driven by the motion transmission mechanism. The motion transmission mechanism comprises a rocking arm, and the rocking arm is a crank which is composed of a connecting shaft and a rocking shaft. The end of the connecting shaft connects to the top of the driving blade. The end of the rocking shaft is a gear, and the gear of the rocking arm has teeth which mesh with teeth of at least one gear of the gear cluster. The motion transmission mechanism comprises a double pole changeover switch and a micro switch.

10 Claims, 6 Drawing Sheets

STAPLER THAT REQUIRES EXERTION OF LESS EFFORT

BACKGROUND OF THE INVENTION

The present invention relates to staplers and more particularly pertains to staplers of the kind which requires exertion of less effort.

At present, the common electric staplers in the marketplace mainly achieve stapling by means of utilizing an electric motor to drive a gear cluster and then to drive a driving blade. A gear cluster generally requires a greater range of rotation and more time for stapling and resetting. Moreover, to increase the reliability of motion transmission, the prior art has some staplers which are complex in construction, and some of which have a gear cluster which is composed of five or more transmitting gears, thereby making the body of the staplers bulky, heavy and inconvenient for use.

The prior art also provides some technical proposals which add a transmitting shaft or an eccentric wheel to the gear cluster so as to reduce the range of rotation of gears as required and to save the time required for stapling and resetting. However, the angle of the movement of the transmitting shaft or the eccentric wheel of the prior art is still large. The market is therefore looking forward to electric staplers which are capable of further saving the time required for stapling and resetting.

Furthermore, incidents of staples being popped out or staples being driven in wrong positions still happen commonly in existing electric staplers. Though the prior art provides electric staplers which are of construction with a staple guiding plate disposed at the front end of a staple magazine, it cannot ensure that each staple is accurately and completely driven through sheets of paper or other materials to be stapled and is difficult to ensure the consistency of the stapling quality, because the staple guiding plate is fixed at the front end of the staple magazine and it cannot move downward simultaneously with the staple during the stapling process.

BRIEF SUMMARY OF THE INVENTION

In view of the aforesaid disadvantages now present in the prior art, the object of the present invention is to provide an electric stapler which is of a simple and practical construction, has components for rotation with a smaller angle of movement, requires less time for stapling and resetting, requires less time and effort for operation, and is capable of ensuring the consistency of the stapling quality.

To attain this, the stapler that requires exertion of less effort of the present invention generally comprises a body, an electric motor, a power supply, a power supply switch, a motion transmission mechanism having a gear cluster driven by the electric motor, a staple driving mechanism having a driving blade and a staple magazine driven by the motion transmission mechanism, which is characterized in that the motion transmission mechanism comprises a rocking arm, and the rocking arm is a crank which is composed of a connecting shaft and a rocking shaft, the end of the connecting shaft connects to the top of the driving blade, the end of the rocking shaft is a gear, and the gear of the rocking arm has teeth which mesh with teeth of at least one gear of the gear cluster.

The staple driving mechanism comprises a staple guiding plate which is engaged with the front end of the staple magazine and connects to a compression spring. The driving blade brings along the staple guiding plate to slide downward, and the compression spring brings along the staple guiding plate to follow the driving blade to slide upward back to its original position.

The staple driving mechanism further comprises a button, a fastener, an outer staple magazine, an inner staple magazine, and a spring. The button connects to the fastener. The fastener connects to and is engaged with the inner staple magazine. The inner staple magazine is disposed inside the outer staple magazine and is slidingly engaged with it. The spring connects with the inner staple magazine and the outer staple magazine. By pressing the button, it drives the fastener to rotate until it is separated from the inner staple magazine, and the inner staple magazine ejects due to the spring effect. By pushing in the inner staple magazine, it connects to and is engaged with the fastener again.

The gear of the rocking arm is in the form of an arc and has straight-cut teeth. The number of teeth is 21. The module (that is the pitch diameter's ratio to the number of teeth expressed in millimeters) is 0.6. The standard pressure angle is 20°. The gear of the rocking arm can swing back and forth. The angle between the rocking shaft and the horizontal plane is between 100° and 102°. The rocking shaft can swing along with the gear of the rocking arm and the angle between the rocking shaft and the horizontal plane is between 139° and 141°. The gear of the rocking arm is only required to swing back and forth at any angle between 37° and 41°. The gear of the rocking arm can also swing back and forth at any angle between 37° and 80°.

The gear cluster comprises 1 driving gear and 4 driven gears. The driving gear has straight-cut teeth. The number of teeth is 10. The module is 0.6 and the standard pressure angle is 20°. The driving gear connects to the electric motor and is driven by the electric motor. The driven gears comprise a first driven gear, a second driven gear, a third driven gear, and a fourth driven gear. The first driven gear comprises one big gear and one small gear each with straight-cut teeth and the two gears are disposed parallel to each other. The number of teeth of the big gear is 30 and the module is 0.6. The number of teeth of the small gear is 19 and the module is 0.6. The standard pressure angle of each of the two gears is 20°. The big gear and the driving gear are intermeshed. The first driven gear is driven by the driving gear. The second driven gear comprises one big gear and one small gear each with straight-cut teeth and the two gears are disposed parallel to each other. The number of teeth of the big gear is 34 and the module is 0.6. The number of teeth of the small gear is 12 and the module is 0.6. The standard pressure angle of each of the two gears is 20°. The big gear of the second driven gear and the small gear of the first driven gear are intermeshed. The second driven gear is driven by the first driven gear. The third driven gear comprises one big gear and one small gear each with straight-cut teeth and the two gears are disposed parallel to each other. The number of teeth of the big gear is 34 and the module is 0.6. The number of teeth of the small gear is 12 and the module is 0.6. The standard pressure angle of each of the two gears is 20°. The big gear of the third driven gear and the small gear of the second driven gear are intermeshed. The third driven gear is driven by the second driven gear. The fourth driven gear has straight-cut teeth. The number of teeth is 38. The module is 0.6 and the standard pressure angle is 20°. The fourth driven gear and the small gear of the third driven gear are intermeshed. The fourth driven gear is driven by the third driven gear. The fourth driven gear and the gear of the rocking arm are intermeshed. By using the small gears to drive the big gears, torque can be increased and more effort can be saved. The gear cluster of the present invention comprises 5 gears. 5 gears can better utilize space and locations, and this is a preferred embodiment. The present invention is capable of other embodiments which uses any other number of gears to transmit motion.

The gear of the rocking arm is disposed inside the body near the front end of the staple magazine. The gear cluster is disposed inside the body near the rear end of the staple magazine.

The power supply is a 9-volt battery which is disposed at the bottom inside the body. The power supply switch is a toggle switch. By turning off the power supply switch, the electric circuit can be immediately disconnected.

The motion transmission mechanism further comprises a double pole changeover switch and a micro switch. When the gear of the rocking arm swings to a position which is the nearest to the front end of the staple magazine, the gear of the rocking arm contacts the micro switch. When the double pole changeover switch is actuated, the electric circuit is connected. The power supply provides electricity to the electric motor. The electric motor rotates and drives the gear cluster to rotate and the gear of the rocking arm to swing upward. When the double pole changeover switch is deactivated, it changes the electric circuit so that the electric motor rotates reversely. The electric motor drives the gear cluster to rotate reversely and the gear of the rocking arm to swing downward until the gear of the rocking arm contacts the micro switch. The micro switch then disconnects the electric circuit. The electric motor ceases to rotate.

The operation of the present invention is set out as follows:

To use the present invention for stapling, the user first turns on the power supply switch and then actuates the double pole changeover switch. The electric circuit is connected. The power supply provides electricity to the electric motor. The electric motor is actuated. The electric motor drives the gear cluster, that is, the electric motor drives the driving gear, the driving gear drives the first driven gear, the first driven gear drives the second driven gear, the second driven gear drives the third driven gear, the third driven gear drives the fourth driven gear, and the fourth driven gear drives the gear of the rocking arm to swing upward, the rocking shaft to swing upward, the connecting shaft to swing downward, and the top of the driving blade which connects to the connecting shaft to move downward. The driving blade therefore drives a staple out from the staple magazine and the staple is inserted into sheets of paper or other materials to be stapled. The staple guiding plate slides downward simultaneously with the driving blade. The staple and the staple guiding plate move downward simultaneously. The staple guiding plate ensures that each staple is accurately and completely driven through the sheets of paper or other materials to be stapled.

After finishing stapling, the user then deactivates the double pole changeover switch, and the electric circuit is changed to drive the electric motor to rotate reversely. The electric motor reversely drives the gear cluster and the gear of the rocking arm to drive the rocking shaft to swing downward, the connecting shaft to swing upward, the top of the driving blade which connects to the connecting shaft to move upward. The compression spring brings along the staple guiding plate to follow the driving blade to slide upward back to its original position until the gear of the rocking arm swings to a position which is the nearest to the front end of the staple magazine, and by then the gear of the rocking arm contacts the micro switch. The micro switch then disconnects the electric circuit. The electric motor ceases to rotate. The driving blade and the staple guiding plate return to their original positions.

When the staples are used up, the user turns off the power supply switch and presses the button to drive the fastener to rotate until it is separated from the inner staple magazine. The inner staple magazine ejects due to the spring effect. The user then places new staples inside the inner staple magazine and then pushes in the inner staple magazine to engage with the fastener. The user turns on the power supply switch and the present invention is then ready for use.

In comparison with the prior art, the present invention has the following advantages and effects:

First, since the motion transmission mechanism of the present invention uses the rocking arm and its gears to drive the staple driving mechanism to staple, the angle of the swing of the gear of the rocking arm as required is smaller, and the range of rotation of the gear cluster as required is smaller as compared with that of the prior art or that of the technical proposal of adding a transmitting shaft or an eccentric wheel to the gear cluster of the prior art. Therefore, it requires less time for stapling and resetting. Its operation requires less time and effort. Furthermore, the motion transmission mechanism of the present invention comprises 5 gears only. It is of a simple and practical construction, and the size of the present invention is light and compact and is therefore convenient for use.

Secondly, as the staple driving mechanism of the present invention comprises a staple guiding plate which can follow the driving blade to slide upward and downward at the front end of the staple magazine, this can ensure that each staple is accurately and completely driven through sheets of paper or other materials to be stapled. The consistency of the stapling quality can also be ensured. Incidents of staples being driven in wrong positions or staples being popped out can be effectively prevented from happening.

Thirdly, as the gear cluster of the present invention is disposed inside the body near the rear end of the staple magazine, that is, near the rear part of the body, while the rocking arm is disposed inside the body near the front end of the staple magazine, this can increase the distance between the gear cluster and the rocking arm, that is, the distance between the effort and the fulcrum of a lever, thereby attaining the effect of requiring less effort by having greater distance from the fulcrum pursuant to the principle of leverage. Accordingly, the present invention requires less time and effort as compared with the prior art.

DETAILED DESCRIPTION OF THE INVENTION

The present invention is further described in detail with the following embodiment and the accompanying drawings.

Figure 1:
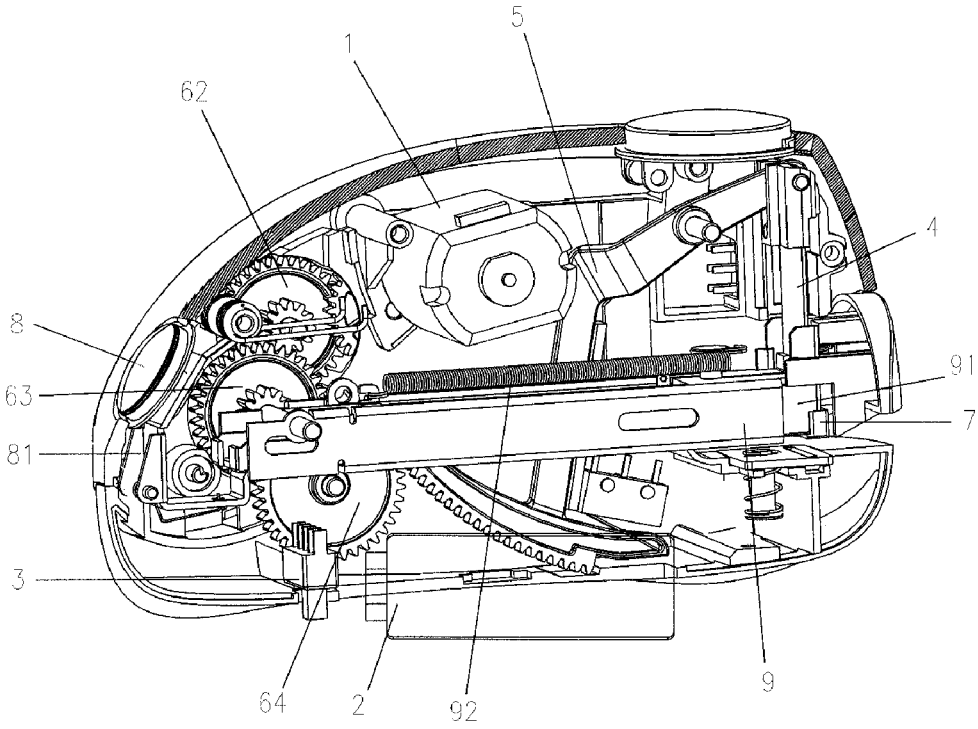
FIG. 1 shows the construction of the present invention.

FIGS. 1 to 10 illustrate the detailed construction of an embodiment of the present invention. As illustrated in FIG. 1, the present invention comprises a body, an electric motor 1, a power supply 2, a power supply switch 3, a motion transmission mechanism having a gear cluster driven by the electric motor 1, and a staple driving mechanism having a driving blade 4 and a staple magazine driven by the motion transmission mechanism.

Figure 2:
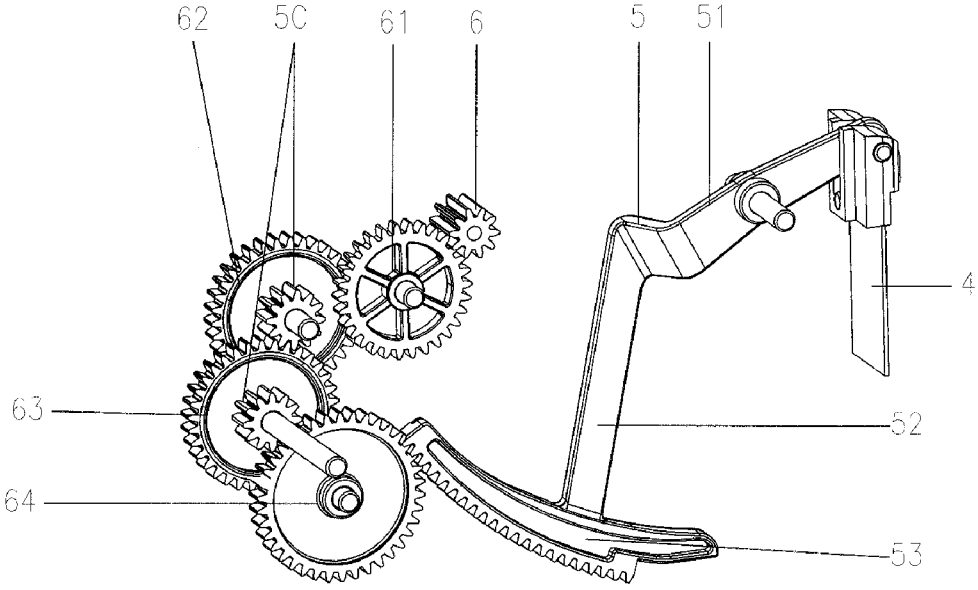
FIG. 2 shows the construction of the gear cluster and the gear of the rocking arm of the present invention as in FIG. 1.

As illustrated in FIG. 2, the motion transmission mechanism comprises a rocking arm 5, and the rocking arm 5 is a crank which is composed of a connecting shaft 51 and a rocking shaft 52, the end of the connecting shaft 51 connects to the top of the driving blade 4, the end of the rocking shaft 52 is a gear 53, and the gear 53 of the rocking arm has teeth which mesh with teeth of at least one gear of the gear cluster, and in other embodiments, teeth of the gear 53 of the rocking arm may mesh with teeth of more than one gear of the gear cluster. As illustrated in FIG. 1, the gear 53 of the rocking arm is disposed inside the body near the front end of the staple magazine, and the gear cluster is disposed inside the body near the rear end of the staple magazine.

Figure 3:
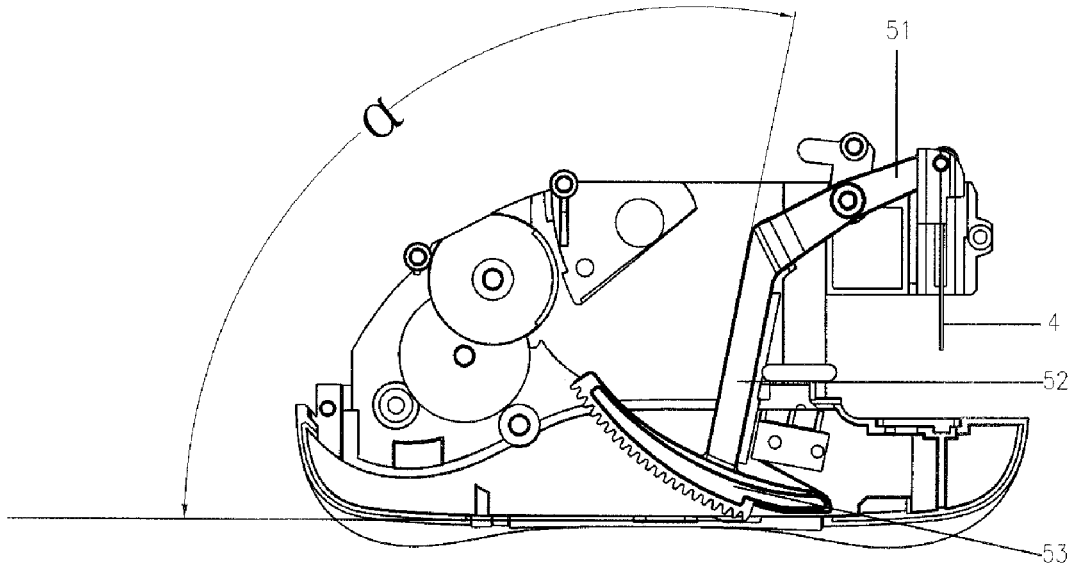
FIG. 3 shows the construction of the present invention while not in use as in FIG. 1.
Figure 4:
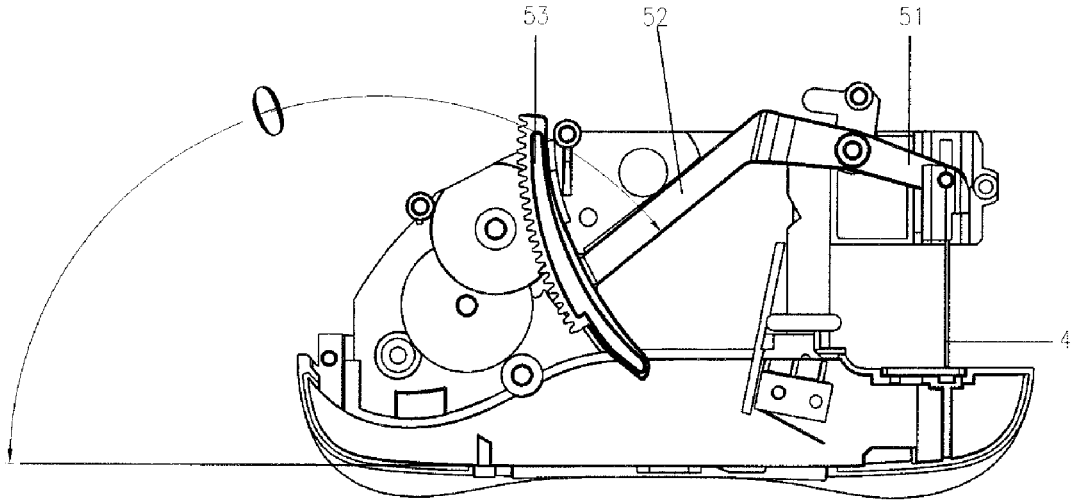
FIG. 4 shows the construction of the present invention while in use as in FIG. 1.
Figure 5:
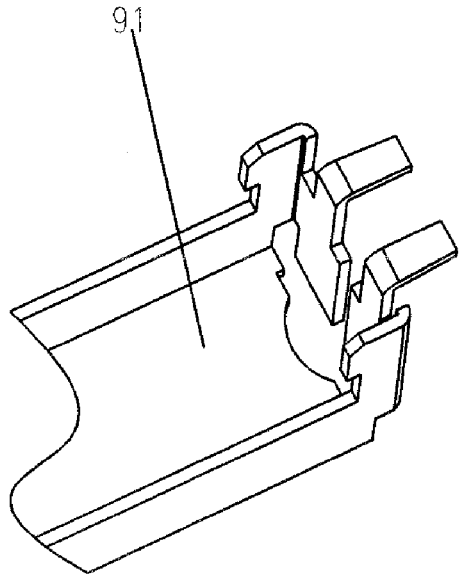
FIG. 5 shows the construction of the front end of the staple magazine of the present invention as in FIG. 1.
Figure 6:
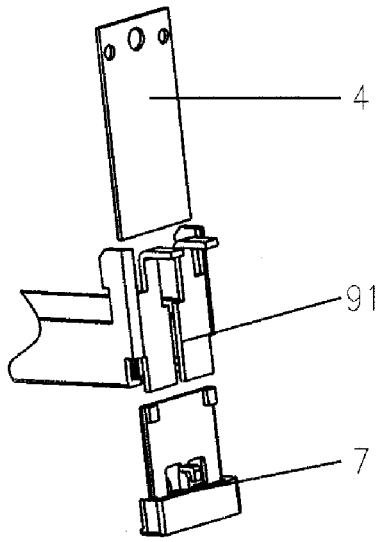
FIG. 6 shows the exploded view of the staple guiding plate of the present invention as in FIG. 1.
Figure 7:
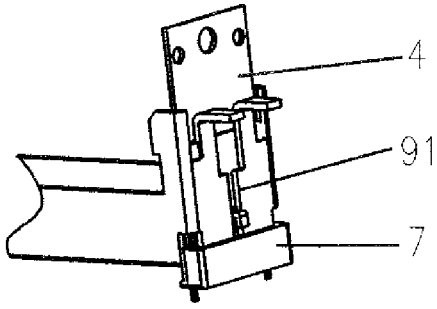
FIG. 7 shows the construction of the staple guiding plate of the present invention as in FIG. 1 while in use.
Figure 8:
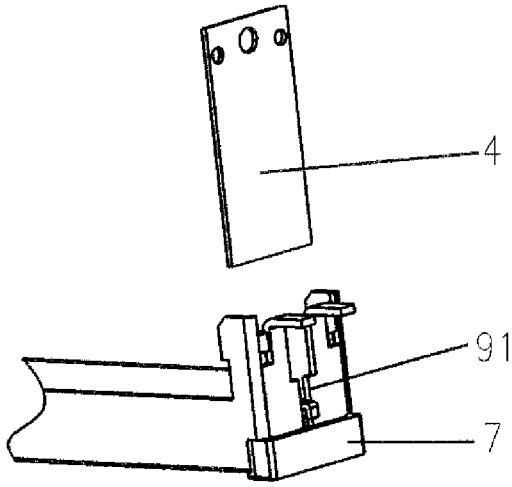
FIG. 8 shows the construction of the staple guiding plate of the present invention as in FIG. 1 while not in use.

As illustrated in FIGS. 2 to 4, the gear 53 of the rocking arm is in the form of an arc and has straight-cut teeth. The number of teeth is 21. The module is 0.6 and the standard pressure angle is 20°. The gear 53 of the rocking arm can swing back and forth. In this embodiment, the angle $\alpha$ between the rocking shaft 52 and the horizontal plane is 101.42°, and in other embodiments, the angle $\alpha$ may be within the range from 100° to 102°. The rocking shaft 52 can swing along with the gear 53 of the rocking arm and the angle $\theta$ between the rocking shaft 52 and the horizontal plane is 140.79°, and in other embodiments, the angle $\theta$ may be within the range from 139° to 141°. In this embodiment, the gear 53 of the rocking arm is only required to swing back and forth at an angle of 39.37°, and in other embodiments, the gear 53 of the rocking arm can swing back and forth at an angle within the range from 37° to 41° or it can also swing back and forth at an angle within the range from 37° to 80°.

As illustrated in FIG. 2, the gear cluster in this embodiment comprises 1 driving gear and 4 driven gears. The driving gear 6 has straight-cut teeth. The number of teeth is 10. The module is 0.6 and the standard pressure angle is 20°. The driving gear 6 connects to the electric motor 1 and is driven by the electric motor 1. The driven gears comprise a first driven gear 61, a second driven gear 62, a third driven gear 63, and a fourth driven gear 64. The first driven gear 61 comprises one big gear and one small gear each with straight-cut teeth and the two gears are disposed parallel to each other. The number of teeth of the big gear is 30 and the module is 0.6. The number of teeth of the small gear is 19 and the module is 0.6. The standard pressure angle of each of the two gears is 20°. The big gear and the driving gear 1 are intermeshed. The first driven gear 61 is driven by the driving gear 6. The second driven gear 62 comprises one big gear and one small gear each with straight-cut teeth and the two gears are disposed parallel to each other. The number of teeth of the big gear is 34 and the module is 0.6. The number of teeth of the small gear is 12 and the module is 0.6. The standard pressure angle of each of the two gears is 20°. The big gear of the second driven gear 62 and the small gear of the first driven gear 61 are intermeshed. The second driven gear 62 is driven by the first driven gear 61. The third driven gear 63 comprises one big gear and one small gear each with straight-cut teeth and the two gears are disposed parallel to each other. The number of teeth of the big gear is 34 and the module is 0.6. The number of teeth of the small gear is 12 and the module is 0.6. The standard pressure angle of each of the two gears is 20°. The big gear of the third driven gear 63 and the small gear of the second driven gear 62 are intermeshed. The third driven gear 63 is driven by the second driven gear 62. The fourth driven gear 64 has straight-cut teeth. The number of teeth is 38. The module is 0.6 and the standard pressure angle is 20°. The fourth driven gear 64 and the small gear of the third driven gear 63 are intermeshed. The fourth driven gear 64 is driven by the third driven gear 63. The fourth driven gear 64 and the gear 53 of the rocking arm are intermeshed. By using the small gears to drive the big gears, torque can be increased and more effort can be saved. The gear cluster in this embodiment comprises 5 gears. 5 gears can better utilize space and locations, and this is a preferred construction. In other embodiments, any other number of gears to transmit motion can be used.

Figure 10:
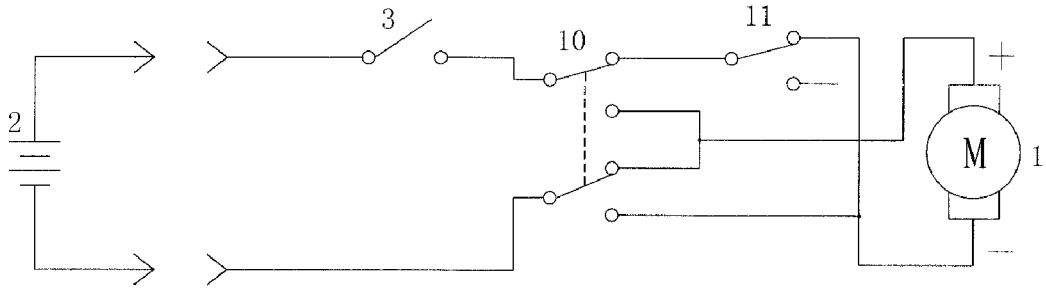
FIG. 10 is the circuit diagram of the present invention as in FIG. 1.
Figure 11:
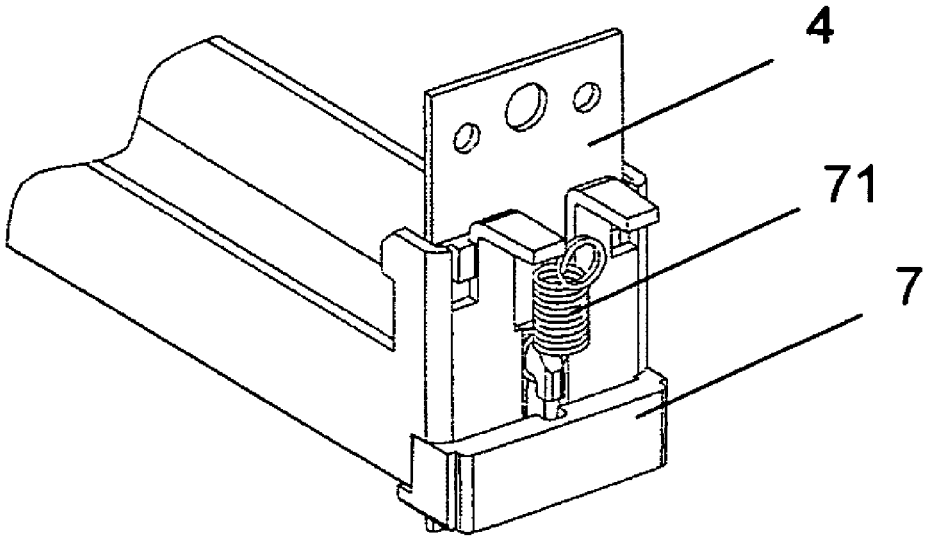
FIG. 11 shows the construction of the staple guiding plate of the present invention connecting with the compression spring.

As illustrated in FIG. 1, the power supply 2 is a 9-volt battery which is disposed at the bottom inside the body. As illustrated in FIGS. 1 and 10, the power supply switch 3 is a toggle switch. By turning off the power supply switch 3, the electric circuit can be immediately disconnected.

Figure 9:
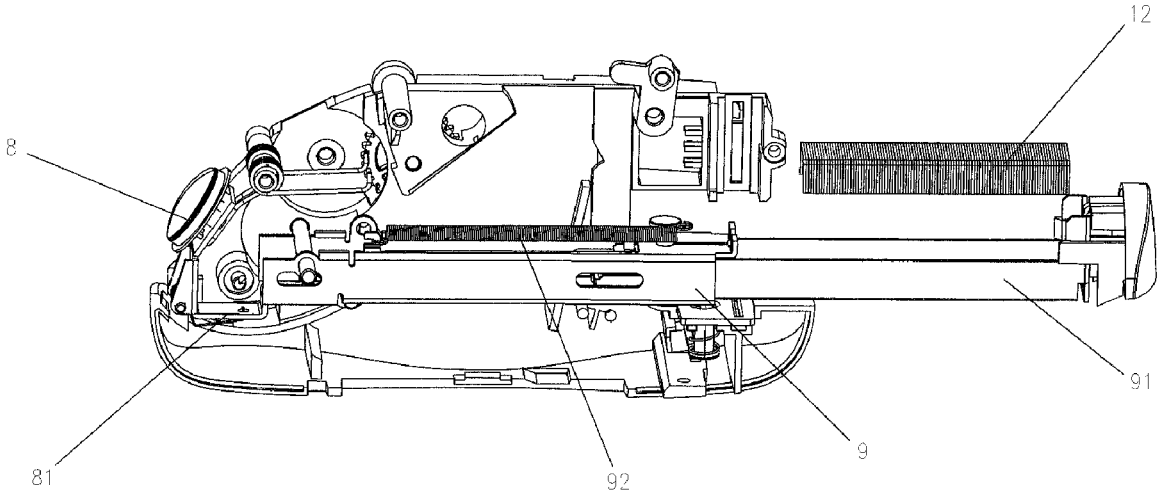
FIG. 9 shows the construction of the inner staple magazine as in FIG. 1 while in use.

As illustrated in FIGS. 5 to 8 and FIG. 11, the staple driving mechanism comprises a staple guiding plate 7 which is engaged with the front end of the staple magazine and connects with a compression spring 71. The driving blade 4 drives along the staple guiding plate 7 to slide downward, and the compression spring brings along the staple guiding plate 7 to follow the driving blade 4 to slide upward back to its original position. As illustrated in FIGS. 1 and 9, the staple driving mechanism further comprises a button 8, a fastener 81, an outer staple magazine 9, an inner staple magazine 91, and a spring 92. The button 8 connects to the fastener 81. The fastener 81 connects to and is engaged with the inner staple magazine 91. The inner staple magazine 91 is disposed inside the outer staple magazine 9 and is slidingly engaged with it. The spring 92 connects with the inner staple magazine 91 and the outer staple magazine 9. By pressing the button 8, it drives the fastener 81 to rotate until it is separated from the inner staple magazine 91, and the inner staple magazine 91 ejects due to the spring 92 effect. By pushing in the inner staple magazine 91, it connects to and is engaged with the fastener 81 again.

As illustrated in FIG. 10, the motion transmission mechanism further comprises a double pole changeover switch 10 and a micro switch 11. When the gear 53 of the rocking arm swings to a position which is the nearest to the front end of the staple magazine, the gear 53 of the rocking arm contacts the micro switch 11. When the double pole changeover switch 10 is actuated, the electric circuit is connected. The power supply 2 provides electricity to the electric motor 1. The electric motor 1 rotates and drives the gear cluster to rotate and the gear 53 of the rocking arm to swing upward. When the double pole changeover switch 10 is deactivated, it changes the electric circuit to drive the electric motor 1 to rotate reversely. The electric motor 1 drives the gear cluster to rotate reversely and the gear 53 of the rocking arm to swing downward until the gear 53 of the rocking arm contacts the micro switch 11. The micro switch 11 then disconnects the electric circuit. The electric motor 1 ceases to rotate.

The operation of the present invention is set out as follows:

To use the present invention for stapling, the user first turns on the power supply switch 3 and then actuates the double pole changeover switch 10. The electric circuit is connected. The power supply 2 provides electricity to the electric motor 1. The electric motor 1 is actuated. The electric motor 1 drives the gear cluster, that is, the electric motor drives the driving gear 6, the driving gear 6 drives the first driven gear 61, the first driven gear 61 drives the second driven gear 62, the second driven gear 62 drives the third driven gear 63, the third driven gear 63 drives the fourth driven gear 64, and the fourth driven gear 64 drives the gear 53 of the rocking arm to swing upward, the rocking shaft 52 to swing upward, the connecting shaft 51 to swing downward, and the top of the driving blade 4 which connects to the connecting shaft 51 to move downward. The driving blade 4 therefore drives a staple 12 out from the staple magazine and the staple 12 is inserted into sheets of paper or other materials to be stapled. The staple guiding plate 7 slides downward simultaneously with the driving blade 4. The staple 12 and the staple guiding plate 7 move downward simultaneously. The staple guiding plate 7 ensures that each staple 12 is accurately and completely driven through the sheets of paper or other materials to be stapled.

After finishing stapling, the user then deactivates the double pole changeover switch 10, and the electric circuit is changed to drive the electric motor 1 to rotate reversely. The electric motor 1 reversely drives the gear cluster and the gear 53 of the rocking arm to drive the rocking shaft 52 to swing downward, the connecting shaft 51 to swing upward, the top of the driving blade 4 which connects to the connecting shaft 51 to move upward. The compression spring brings along the staple guiding plate 7 to follow the driving blade 4 to slide upward back to its original position until the gear 53 of the rocking arm swings to a position which is the nearest to the front end of the staple magazine, and by then the gear 53 of the rocking arm contacts the micro switch 11. The micro switch 11 then disconnects the electric circuit. The electric motor 1 ceases to rotate. The driving blade 4 and the staple guiding plate 7 return to their original positions.

When the staples 12 are used up, the user turns off the power supply switch 3 and presses the button 8 to drive the fastener 81 to rotate until it is separated from the inner staple magazine 91. The inner staple magazine 91 ejects due to the spring 92 effect. The user then places new staples 12 inside the inner staple magazine 92 and then pushes in the inner staple magazine 92 to engage with the fastener 81. The user turns on the power supply switch 3 and the present invention is then ready for use.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A stapler that requires exertion of less effort comprising a body, an electric motor, a power supply, a power supply switch, a motion transmission mechanism having a gear cluster driven by the electric motor, a staple driving mechanism having a driving blade and a staple magazine driven by the motion transmission mechanism, which is characterized in that the motion transmission mechanism comprises a rocking arm, and the rocking arm is a crank which is composed of a connecting shaft and a rocking shaft, the end of the connecting shaft connects to the top of the driving blade, the end of the rocking shaft is a gear, and the gear of the rocking arm has teeth which mesh with teeth of at least one gear of the gear cluster; the motion transmission mechanism further comprises a double pole changeover switch and a micro switch; when the gear of the rocking arm swings to a first position which is the nearest to the front end of the staple magazine, the gear of the rocking arm contacts the micro switch; when the double pole changeover switch is actuated, an electric circuit is connected; the power supply provides electricity to the electric motor, and the electric motor rotates and drives the gear cluster to rotate and the gear of the rocking arm to swing upward to a second position; when the double pole changeover switch is deactivated, it changes the electric circuit to drive the electric motor to rotate reversely, the electric motor drives the gear cluster to rotate reversely and the gear of the rocking arm to swing downward until the gear of the rocking arm contacts the micro switch, the micro switch then disconnects the electric circuit, and the electric motor ceases to rotate.

2. The stapler that requires exertion of less effort as in claim 1, wherein the staple driving mechanism comprises a staple guiding plate which is engaged with the front end of the staple magazine and connects to a compression spring, the driving blade brings along the staple guiding plate to slide downward, and the compression spring brings along the staple guiding plate to follow the driving blade to slide upward back to its original position.

3. The stapler that requires exertion of less effort as in claim 1 or 2, wherein the staple driving mechanism further comprises a button, a fastener, an outer staple magazine, an inner staple magazine, and a spring; the button connects to the fastener, the fastener connects to and is engaged with the inner staple magazine, the inner staple magazine is disposed inside the outer staple magazine and is slidingly engaged with it, the spring connects with the inner staple magazine and the outer staple magazine; and by pressing the button, it drives the fastener to rotate until it is separated from the inner staple magazine, and the inner staple magazine ejects due to the spring effect; and by pushing in the inner staple magazine, it connects to and is engaged with the fastener again.

4. The stapler that requires exertion of less effort as in claim 1, wherein the gear of the rocking arm is in the form of an arc and has straight-cut teeth, and the number of teeth is 21 and it has a module of 0.6 and a standard pressure angle of 20°.

5. The stapler that requires exertion of less effort as in claim 1 or 4, wherein the gear of the rocking arm can swing back and forth and an angle is defined between the rocking shaft and a horizontal plane, the angle between the rocking shaft and the horizontal plane is between 100° and 102°; the rocking shaft can swing along with the gear of the rocking arm and the angle between the rocking shaft and the horizontal plane is between 139° and 141°.

6. The stapler that requires exertion of less effort as in claim 5, wherein the gear of the rocking arm is only required to swing back and forth by 37° to 41° respectively.

7. The stapler that requires exertion of less effort as in claim 5, wherein the gear of the rocking arm can also swing back and forth by 37° to 80° respectively.

8. The stapler that requires exertion of less effort as in claim 1, wherein the gear cluster comprises 1 driving gear and 4 driven gears; the driving gear has straight-cut teeth, a module of 0.6 and a standard pressure angle of 20°, and the number of teeth is 10, the driving gear connects to the electric motor and is driven by the electric motor; the driven gears comprise a first driven gear, a second driven gear, a third driven gear, and a fourth driven gear; the first driven gear comprises one big gear and one small gear each with straight-cut teeth and the two gears are disposed parallel to each other, the number of teeth of the big gear is 30 and the big gear has a module of 0.6, the number of teeth of the small gear is 19 and the small gear has a module of 0.6, and each of the two gears has a standard pressure angle of 20°, the big gear and the driving gear are intermeshed, and the first driven gear is driven by the driving gear; the second driven gear comprises one big gear and one small gear each with straight-cut teeth and the two gears are disposed parallel to each other, the number of teeth of the big gear is 34 and the big gear has a module of 0.6, the number of teeth of the small gear is 12 and the small gear has a module of 0.6, and each of the two gears has a standard pressure angle of 20°, the big gear of the second driven gear and the small gear of the first driven gear are intermeshed, and the second driven gear is driven by the first driven gear; the third driven gear comprises one big gear and one small gear each with straight-cut teeth and the two gears are disposed parallel to each other, the number of teeth of the big gear is 34 and the big gear has a module of 0.6, the number of teeth of the small gear is 12 and the small gear has a module of 0.6, and each of the two gears has a standard pressure angle of 20°, the big gear of the third driven gear and the small gear of the second driven gear are intermeshed, and the third driven gear is driven by the second driven gear; the fourth driven gear has straight-cut teeth, a module of 0.6 and a standard pressure angle of 20°, and the number of teeth is 38, the fourth driven gear and the small gear of the third driven gear are intermeshed, the fourth driven gear is driven by the third driven gear, and the fourth driven gear and the gear of the rocking arm are intermeshed.

9. The stapler that requires exertion of less effort as in claim 1, wherein the gear of the rocking arm is disposed inside the body near the front end of the staple magazine, and the gear cluster is disposed inside the body near the rear end of the staple magazine.

10. The stapler that requires exertion of less effort as in claim 1, wherein the power supply is a 9-volt battery which is disposed at the bottom inside the body; the power supply switch is a toggle switch.

* * * * *